United States Patent [19]

Idenawa et al.

[11] 4,188,109

[45] Feb. 12, 1980

[54] FIXING APPARATUS FOR ELECTROPHOTOGRAPHY

[75] Inventors: Hiroyuki Idenawa; Misao Tanzawa; Yukihiro Ohno, all of Tokyo, Japan

[73] Assignee: Ricoh Company, Ltd., Tokyo, Japan

[21] Appl. No.: 698,457

[22] Filed: Jun. 21, 1976

[30] Foreign Application Priority Data

Jun. 30, 1975 [JP] Japan ..... 50/81225

[51] Int. Cl.[2] ..... G03G 15/00; F27B 9/28; H05B 1/00

[52] U.S. Cl. ..... 355/3 FU; 219/216; 432/60

[58] Field of Search ..... 355/3 R, 3 FU; 219/216; 432/60, 228

[56] References Cited

U.S. PATENT DOCUMENTS

| | | | |
|---|---|---|---|
| 3,240,148 | 3/1966 | Varga | 100/158 R |
| 3,794,417 | 2/1974 | Machmer | 355/14 X |
| 3,918,804 | 11/1975 | Bar-on | 355/3 R |
| 3,937,919 | 2/1976 | Clerx et al. | 432/60 X |
| 3,941,469 | 3/1976 | Okamoto | 355/3 DD |
| 3,965,331 | 6/1976 | Moser et al. | 219/216 |
| 4,008,955 | 2/1977 | Bar-on | 355/3 R |
| 4,017,065 | 4/1977 | Poehlein | 432/60 X |

*Primary Examiner*—Fred L. Braun
*Attorney, Agent, or Firm*—Frank J. Jordan

[57] ABSTRACT

Two fixing rollers are mounted on shafts and rotated to pressingly feed a copy sheet therebetween to fix a toner image to the copy sheet. Spring force is applied to the ends of the shafts to urge the rollers together. The axes of the shafts define an acute angle therebetween to offset a tendency for the pressing force to decrease toward the center of the rollers due to deflection of the shafts and rollers. Feed rollers feed the copy sheet into the bite of the fixing rollers at a speed which is faster than the speed that the fixing rollers feed the copy sheet therebetween. The copy sheet is therefore fed through the fixing rollers in a slackened condition which prevents wrinkling of the copy sheet due to the angle between the shafts.

4 Claims, 4 Drawing Figures

FIXING APPARATUS FOR ELECTROPHOTOGRAPHY

BACKGROUND OF THE INVENTION

The present invention relates to a fixing apparatus for an electrostatic copying machine.

In a known electrophotographic process a photoconductive copy sheet is electrostatically charged and radiated with a light image to locally dissipate the charge to form an electrostatic image on the sheet. The sheet is then developed by applying a dry toner substance thereto which adheres to the high charge areas of the electrostatic image to form a toner image. The sheet is then pressingly fed between two fixing rollers which crush the toner into the copy sheet to fix the toner image to the copy sheet.

These fixing rollers are amounted on shafts for rotation, and a biasing force is applied to the ends of the shafts by springs or the like to urge the rollers together. A problem is encountered in such apparatus in that since the force is applied to the ends of the shafts, the shafts and rollers tend to bow or deflect outwardly in such a manner that the pressing force between the rollers is greatest at the ends and least in the center. This causes uneven fixing of the toner to the sheet. In extreme cases the toner will not be sufficiently pressed into the sheet in the center and will come off the sheet onto the hands of persons handling the sheet, objects which the sheets touches, etc.

Two expedients have been introduced in an attempt to overcome this problem. Increasing the diameter of the rollers also increases their rigidity so that the deflection is reduced. However, increasing the diameter of the rollers also increases the size and cost of the copying apparatus to an impractical degree. A second expedient is to orient the axes of the shafts and thereby the rollers so that they form a small actute angle therebetween. Compressive deformation of the rollers due to the pressing force causes a contact portion with the copy sheet in which the pressure distribution is more uniform than with the shafts and rollers aligned parallel to each other. However, a problem exists in this configuration in that the sheets tend to be wrinkled during passage between the fixing rollers unless the angle is so small as to be ineffective. This not only leads to tearing of the sheets in the wrinkled areas but also damages to the rollers due to high stress concentrations caused by the wrinkles.

SUMMARY OF THE INVENTION

It is therefore an object of the present invention to provide a fixing apparatus for electrophotography which evenly fixes a toner image to a copy sheet, is practical in size and economical to commercially manufacture.

It is another object of the present invention to provide a fixing apparatus comprising two rotating fixing rollers pressed together with their axes forming an acute angle therebetween. Wrinkling of copy sheet pressingly fed between the rollers is prevented by a feed roller assembly which feeds the sheets to the fixing rollers at a faster speed than the sheets are fed through the fixing rollers to slacken the sheets during passage through the fixing rollers.

Other objects together with the foregoing, are attained in the embodiment described in the following description and illustrated in the accompanying drawings.

DESCRIPTION OF THE PREFERRED EMBODIMENT

While the fixing apparatus of the invention is susceptible of numerous physical embodiments, depending on the environment and requirements of use, substantial numbers of the herein shown and described embodiment have been made, tested and used, and all have performed in an eminently satisfactory manner.

Figure 1:
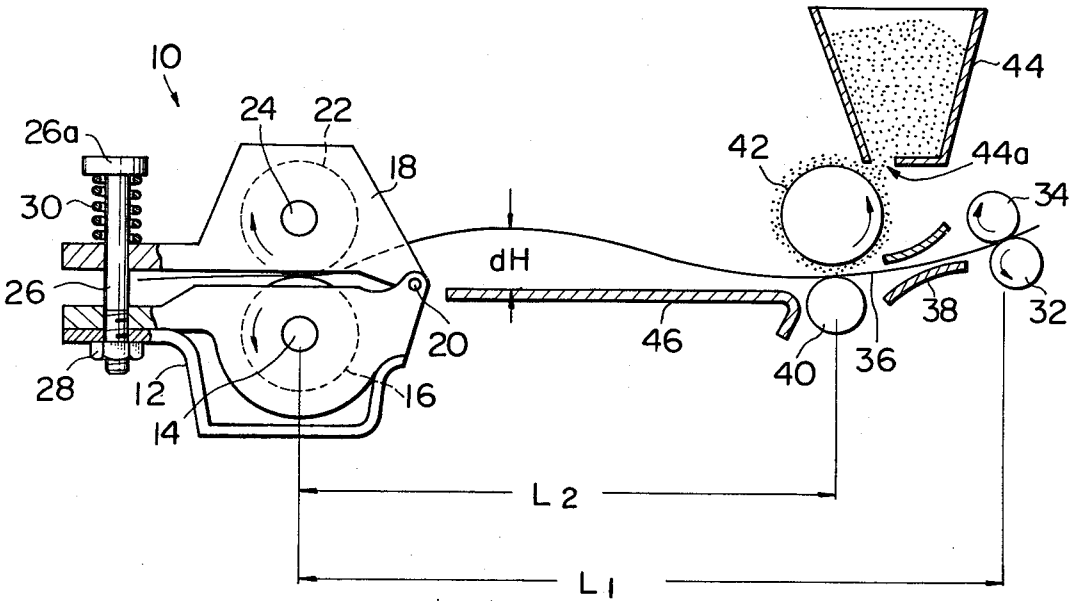
FIG. 1 is a longitudinal sectional view of a fixing apparatus embodying the present invention.

Refferring now to FIG. 1, a fixing apparatus 10 for a copying apparatus embodying the present invention comprises a fixed support member 12 which rotatably supports a shaft 14 on which is fixed a first fixing roller 16. A drive motor (not shown) rotatably drives the rollers 16 counterclockwise. A movable support member 18 is pivotally hinged to the support member 12 by a shaft 20 and rotatably supports a second fixing roller 22 by means of a shaft 24. A bolt 26 is fixed to the support member 12 by means of a nut 28 and extends through a hole (no numeral) in the support member 18 so that a head **26*a* of the bolt 26 is disposed above the support member 18. A compression spring 30 is coaxially disposed around the bolt 26 so that its ends contact the lower surface of the head 26*a* and the upper surface of the support member 18. The bolt 26 is screwed downwardly into the nut 28 so that the spring 30 is compressed thereby pivotally urging the support member 18 toward the support member 12. The ends of the shafts 14 and 24 are retained by the support members 12 and 18 respectively, so that the spring 30 urges the rollers 14 and 24 into pressing engagement with each other. The pressing force is increased to a desired value by screwing the bolt 26 downwardly into the nut 28. Counterclockwise rotation of the roller 16 thereby causes clockwise rotation of the roller 22**.

Feed rollers 32 and 34 are operatively disposed upstream of the fixing rollers 16 and 22 in the copying apparatus, and are urged into pressing engagement with each other. Drive means (not shown) rotatably drives the roller 32 counterclockwise so that the roller 34 is rotated clockwise. A photoconductive copy sheet 36 is charged, and radiated with a light image to produce an electrostatic image of an original document by means which do not constitute part of the present invention and are not shown. The rollers 32 and 34 feed the copy sheet 36 through a guide 38 between a guide roller 40 and a developing roller 42. A hopper 44 is disposed above the developing roller 42 so that a toner substance provided in the hopper 44 falls through an opening **44*a* in the bottom of the hopper 44 onto the surface of the developing roller 42. The developing roller 42 is preferably rotated counterclockwise, and a small gap is provided between the copy sheet 36 and the developing roller 42. The toner substance is deposited on the sheet 36 in an even manner by the developing roller 42** and adheres to the high charge areas of the electrostatic image on the sheet 36 to produce a toner image. The sheet 36 is fed by the feed rollers 32 and 34 over a guide plate 46 into the bite of the fixing rollers 16 and 22 and the toner image is fixed to the copy sheet 36 as the sheet 36 is pressingly fed through the rollers 16 and 22.

Figure 2:
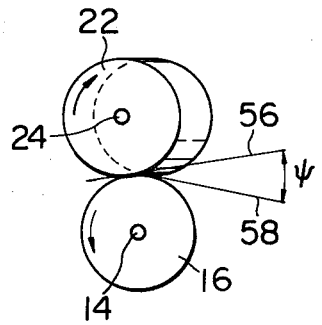
FIG. 2 is a schematic side view of first and second fixing rollers of the apparatus.
Figure 3:
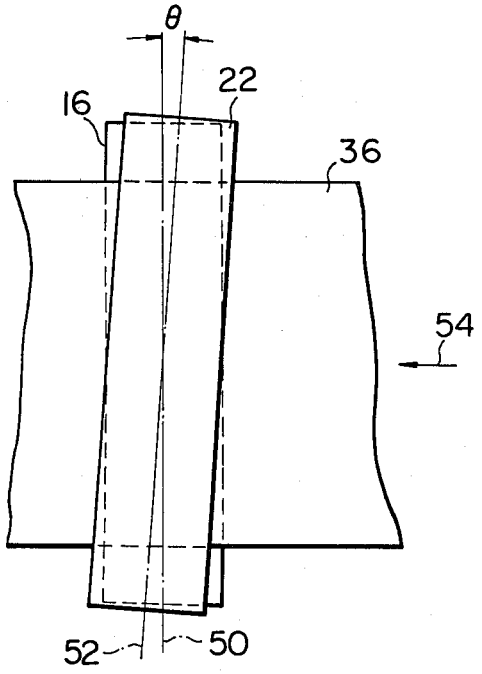
FIG. 3 is a schematic overhead view of the first and second fixing rollers.

Referring now to FIGS. 2 and 3, the shafts 14 and 24 and rollers 16 and 22 have axes 50 and 52 respectively which form a small acute angle $\theta$ therebetween in the horizontal plane. The axis 50 of the shaft 14 and roller 16 is perpendicular to the feed direction of the sheet 36 from the feed rollers 32 and 34 designated by an arrow 54. In FIG. 2, tangent lines to the points of contact of the rollers 16 and 22 at the opposite ends thereof are designated as 56 and 58, and an angle $\psi$ is formed therebetween in the vertical plane. The purpose of this configuration is to make the pressing force between the rollers 16 and 22 more uniform, rather than having a high force at the ends of the rollers 16 and 22 and a substantially lower force in the central portion thereof.

A problem is inherent in this configuration as practiced in the prior art in that if the angle $\theta$ is increased to a practical value to make the pressing force between the rollers 16 and 22 sufficiently uniform, the sheet 36 tends to be wrinkled by the rollers 16 and 22 to tear the sheet 36 and damage the rollers 16 and 22. This is because the roller 22 exerts on the sheet 36 pressures acting in different directions in such a manner that the upper portion of the sheet 36 in FIG. 3 is subject to a downward force, while the lower portion thereof is subject to an upward force.

Referring again to FIG. 1, the present invention overcomes this wrinkling problem by ensuring that the sheet 36 is fed through the rollers 16 and 22 in a slackened condition. In order to acheive this, the feed rollers 32 and 34 are driven at a speed such that the sheet 36 is fed faster by the feed rollers 32 and 34 than by the fixing rollers 16 and 22. This causes the sheet 36 to be bowed upwardly as shown in FIG. 1 so that a gap dH is formed between the sheet 36 and the guide plate 46. It has been proven in practice that if the sheet 36 is maintained in a slackened state in this manner and the upper portion of the leading end of the sheet 36 in FIG. 3 is upwardly fed to the rollers 16 and 22 while the lower portion thereof is downwardly fed to the rollers 16 and 22 so as to be bit therebetween, then the sheet 36 will not be wrinkled by the rollers 16 and 22 as it is pressingly fed therebetween to fix the toner image to the sheet 36 even if the value of the angle $\theta$ is sufficiently large.

The value of the gap dH is determined by the difference between the feed speeds of the feed rollers 32 and 34 and the fixing rollers 16 and 22. Specifically, the greater the speed difference, the greater the gap dH. In order to prevent wrinkling, it is desirable to have the gap dH as large as is practically feasible.

Since the copy sheet 36 is fed into the bite of the fixing rollers 16 and 22 by the feed rollers 32 and 34, a distance $L_1$ between the feed rollers 32 and 34 and the fixing rollers 16 and 22 must be less than the length of the copy sheet 36. Another factor which must be considered is that a gap must be provided between the upper surface of the copy sheet 36 and the developing roller 42 in order to properly develop the electrostatic image into the toner image. As the gap dH is increased, the gap between the sheet 36 and developing roller 42 decreases. There is a practical limit to the gap dH for this reason. It is advantageous to provide the developing roller 42 at a distance $L_2$ from the fixing rollers 16 and 22 which is as large as possible to minimize the effect of the gap dH on the gap between the copy sheet 36 and developing roller 42.

In a practical copying apparatus in which the distance $L_2$ between the developing roller 42 and the fixing rollers 16 and 22 is 120 mm, the difference in the feed speeds of the feed rollers 32 and 34 is preferably selected so that the gap dH between the copy sheet 36 and the guide plate 46 is maintained at approximately 10 to 20 mm.

Figure 4:
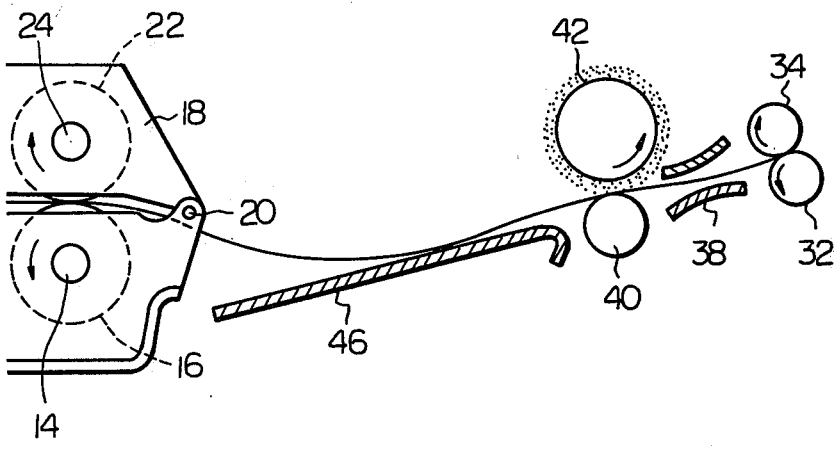
FIG. 4 is a partial longitudinal sectional view similar to FIG. 1 but showing an alternate embodiment.

As shown in FIG. 4, the guide plate 46 may be modified so as to be bent downwardly in such a manner that the copy sheet 36 bows downwardly rather than upwardly as illustrated in FIG. 1. This would cause the copy sheet 36 to be bent downwardly over the guide roller 40 and eliminate the effect of the gap dH on the gap between the copy sheet 36 and the developing roller 42.

Next, the method of the invention will be described in which the peripheral speed of the feed rollers 32 and 34 is increased over that of the fixing rollers 16 and 22 so as to convey the sheet 32 in a slackened condition to the fixing rollers 16 and 22.

Now assuming the following nomenclature:

$N_M$ . . . the number of revolutions of the drive means (e.g., a motor), $Z_M$ . . . the number of teeth on the sprocket (not shown) of the drive means, $N_1$ . . . the number of revolutions of the feed rollers 32 and 34, $Z_1$ . . . the number of teeth on the sprocket (not shown) of the feed rollers 32 and 34, $D_1$ . . . the roller diameter of the feed rollers 32 and 34, $N_2$ . . . the number of revolutions of the fixing rollers 16 and 22, $Z_2$ . . . the number of teeth on the sprocket of the fixing rollers 16 and 22, $D_2$ . . . the roller diameter of the fixing rollers 16 and 22, $V_1$ . . . the peripheral speed of the feed rollers 32 and 34, $V_2$ . . . the peripheral speed of the fixing rollers 16 and 22, then the following equations hold:

$$V_1 = \frac{\pi D_1 N_1}{60} \quad (1)$$

$$V_2 = \frac{\pi D_2 N_2}{60} \quad (2)$$

From equations (1) and (2), we obtain $$N_M Z_M = N_1 Z_1 = N_2 Z_2 = k = \text{const} \quad (3)$$

From equations (1) to (3), we obtain $$\Delta V = V_1 - V_2 = \frac{\pi k}{60}\left(\frac{D_1}{Z_1} - \frac{D_2}{Z_2}\right) \quad (4)$$

As will be seen from the above equations (1) to (4), any one of the following three methods may be used to increase the peripheral speed of the feed rollers 32 and 34 over that of the fixing rollers 16 and 22:

(1) Using the feed rollers and the fixing rollers which are the same in roller diameter, but are different in the number of teeth on their sprockets. Namely, the sprocket of the feed rollers is selected to have a smaller number of teeth than the number of teeth on the sprocket of the fixing rollers.

(2) Using the feed rollers and the fixing rollers which are the same in the number of teeth on their sprockets, but are different in roller diameter. Namely, the roller diameter of the feed rollers is selected greater than that of the fixing roller.

(3) Using the feed rollers and the fixing rollers which are different both in roller diameter and the number of teeth on their sprockets.

Thus, with the present invention, any one of the above-mentioned methods is employed to obtain the desired slackened condition of the sheet 32.

Other modifications within the scope of the invention will become possible for those skilled in the art after receiving the teachings of the present disclosure.

What is claimed is:

1. An electrophotographic copying apparatus comprising in combination:

feed means having first and second rotating feed rollers to feed a copy sheet;

developing means to form a toner image on said copy sheet, said developing means comprising a developing roller disposed above the path of travel of said copy sheet;

fixing means having first and second rotating fixing rollers to pressingly feed said copy sheet therebetween to fix the toner image to said copy sheet, said first and second fixing rollers having a bite at the point of contact therebetween;

an axis of said second fixing roller forming an acute angle with an axis of said first fixing roller such that a tangent line at the point of contact of the two fixing rollers at one longitudinal end of the fixing rollers extends downwardly in the direction of feed of the copy sheet and at the other longitudinal end extends upwardly in the direction of feed of the copy sheet;

said developing roller being located between said feed rollers and said fixing rollers and closer to said feed rollers than said fixing rollers;

the distance between said feed rollers and said fixing rollers being less than the length of said copy sheet;

said feed rollers feeding said copy sheet to said fixing rollers at a speed higher than the speed at which said fixing rollers feeds said copy sheet therebetween such that said copy sheet between said fixing rollers and feed rollers bows generally upwardly to permit one side portion of the leading end of the copy sheet to be fed downwardly into said bite at the point of contact between said fixing rollers at said one longitudinal end of the fixing rollers and to permit the other side portion of the leading end of the copy sheet to be fed upwardly into the bite at the point of contact between said fixing rollers at said other longitudinal end of the fixing rollers, thereby precluding wrinkling of said copy sheet as the latter is fed to said fixing rollers while said generally upward bow does not exceed a height which would eliminate a gap between said bowed copy sheet and said overlying developing roller, said location of said developing roller closer to said feed rollers than said fixing rollers maximizing the distance of said upward bow from said developing means.

2. An apparatus as in claim 1, wherein one of said first and second rotating fixing rollers has a longitudinal axis disposed at an acute angle relative to the direction of the path of travel of the copy sheet, the other of said first and second fixing rollers having a longitudinal axis perpendicular to said direction of the path of travel of the copy sheet.

3. An electrophotographic copying apparatus comprising in combination:

feed means having first and second rotating feed rollers to feed a copy sheet;

developing means to form a toner image on said copy sheet, said developing means comprising a developing roller disposed above the path of travel of said copy sheet and a guide roller spaced from said developing roller below the copy sheet;

fixing means having first and second rotating fixing rollers to pressingly feed said copy sheet therebetween to fix the toner image to said copy sheet, said first and second fixing rollers having a bite at the point of contact therebetween;

an axis of said second fixing roller forming an acute angle with an axis of said first fixing roller such that a tangent line at the point of contact of the two fixing rollers at one longitudinal end of the fixing rollers extends downwardly in the direction of feed of the copy sheet and at the other longitudinal end extends upwardly in the direction of feed of the copy sheet;

said developing roller being located between said feed rollers and said fixing rollers and closer to said feed rollers than said fixing rollers;

the distance between said feed rollers and said fixing rollers being less than the length of said copy sheet;

said feed rollers feeding said copy sheet to said fixing rollers at a speed higher than the speed at which said fixing rollers feeds said copy sheet therebetween such that said copy sheet between said fixing rollers and feed rollers bows generally downwardly to permit one side portion of the leading end of the copy sheet to be fed downwardly into said bite at the point of contact between said fixing rollers at said one longitudinal end of the fixing rollers and to permit the other side portion of the leading end of the copy sheet to be fed upwardly into the bite at the point of contact between said fixing rollers at said other longitudinal end of the fixing rollers, thereby precluding wrinkling of said copy sheet as the latter is fed to said fixing rollers, said copy sheet bending generally downwardly against said underlying guide roller and providing a gap between the copy sheet and the overlying developing roll.

4. An electrophotographic copying apparatus as in claim 3 further comprising a guide plate between said developing means and said fixing means, said guide plate sloping downwardly in the direction of feed of the copy sheet.

* * * * *